US009580999B2

(12) United States Patent
Cunningham et al.

(10) Patent No.: US 9,580,999 B2
(45) **Date of Patent: *Feb. 28, 2017**

(54) GRAVEL PACKING APPARATUS HAVING A JUMPER TUBE PROTECTION ASSEMBLY

(71) Applicant: Halliburton Energy Services, Inc., Houston, TX (US)

(72) Inventors: Gregory Scott Cunningham, Grapevine, TX (US); Brandon Thomas Least, Dallas, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/609,857

(22) Filed: Jan. 30, 2015

(65) Prior Publication Data

US 2015/0136391 A1 May 21, 2015

Related U.S. Application Data

(63) Continuation of application No. 13/898,375, filed on May 20, 2013, now Pat. No. 8,967,240.

(51) Int. Cl.
*E21B 43/04* (2006.01)
*E21B 43/08* (2006.01)

(52) U.S. Cl.
CPC ..... *E21B 43/04* (2013.01); *E21B 43/086* (2013.01)

(58) Field of Classification Search
CPC ..... E21B 43/14; E21B 43/04; E21B 43/08; E21B 17/02; E21B 17/1035; E21B 43/10; E21B 19/16
See application file for complete search history.

(56) References Cited

U.S. PATENT DOCUMENTS 3,119,451 A 1/1964 Hall
3,894,780 A 7/1975 Broussard
4,378,294 A * 3/1983 Wagner et al. ..... 210/460
5,095,981 A 3/1992 Mikolajczyk
(Continued)

OTHER PUBLICATIONS

International Search Report and Written Opinion, PCT/US2012/060705, KIPO, Apr. 25, 2013.
(Continued)

*Primary Examiner* — Kipp Wallace
(74) *Attorney, Agent, or Firm* — Haynes and Boone, LLP

(57) ABSTRACT

A gravel packing apparatus is provided, including first and second joints, each including a sand control screen assembly including a base pipe and a filter medium positioned exteriorly of the base pipe; and a slurry delivery subassembly positioned exteriorly of the sand control screen assembly, the slurry delivery subassembly including a ring assembly positioned around the base pipe; and a transport tube extending through the ring assembly and longitudinally along the sand control screen assembly; a jumper tube coupled to, and extending between, the transport tube of the first joint and the transport tube of the second joint; and a cage assembly extending circumferentially about respective portions of the first and second joints and positioned exteriorly of the jumper tube, the cage assembly comprising a plurality of cage sections that are each independently connected to the respective ring assemblies of the first and second joints. A method is also provided.

20 Claims, 9 Drawing Sheets

(56) References Cited

U.S. PATENT DOCUMENTS

| | | | | |
|---|---|---|---|---|
| 5,787,980 | A * | 8/1998 | Sparlin et al. | 166/231 |
| 5,868,200 | A * | 2/1999 | Bryant et al. | 166/51 |
| 6,283,205 | B1 | 9/2001 | Cannon | |
| 6,923,262 | B2 | 8/2005 | Broome et al. | |
| 8,215,406 | B2 | 7/2012 | Dale et al. | |
| 8,967,240 | B2 * | 3/2015 | Cunningham | E21B 43/04 166/278 |
| 2003/0131997 | A1 | 7/2003 | Chatterji et al. | |
| 2003/0201100 | A1 | 10/2003 | Al-Ramadhan | |
| 2008/0314589 | A1 | 12/2008 | Guignard et al. | |
| 2009/0294128 | A1 | 12/2009 | Dale et al. | |
| 2010/0139919 | A1 | 6/2010 | Yeh et al. | |
| 2010/0155064 | A1 | 6/2010 | Nutley et al. | |
| 2010/0236779 | A1 | 9/2010 | Nutley et al. | |
| 2011/0114307 | A1 | 5/2011 | Casassa et al. | |
| 2012/0125689 | A1 | 5/2012 | Howlett | |
| 2012/0168159 | A1 | 7/2012 | Edwards et al. | |
| 2013/0118738 | A1 | 5/2013 | Ellis et al. | |
| 2013/0220635 | A1 | 8/2013 | Greci et al. | |

OTHER PUBLICATIONS

Invitation to Respond to Written Opinion issued by the Intellectual Property Office of Singapore regarding related Singapore Patent Application No. 11201502337S dated Mar. 18, 2016, 4 pages.

Notice of Acceptance issued by IP Australia regarding related Australian Patent Application 2012392541, dated May 20, 2016, 2 pages.

Patent Examination Report No. 1 issued by IP Australia regarding related Australian Patent Application 2012392541, dated Nov. 25, 2015, 3 pages.

* cited by examiner

GRAVEL PACKING APPARATUS HAVING A JUMPER TUBE PROTECTION ASSEMBLY

CROSS REFERENCE TO RELATED APPLICATIONS

This application is a continuation of U. S. application Ser. No. 13/898,375, which claims priority to International Application No. PCT/US2012/060705, filed Oct. 18, 2012, the entire disclosures of which are hereby incorporated herein by reference.

TECHNICAL FIELD OF THE INVENTION

This invention relates, in general, to equipment utilized in conjunction with operations performed in relation to subterranean wells and, in particular, to a gravel packing apparatus having a jumper tube protection assembly and a method for assembling the gravel packing apparatus on the rig floor.

BACKGROUND OF THE INVENTION

Without limiting the scope of the present invention, its background is described with reference to a sand control completion in a wellbore traversing an unconsolidated or loosely consolidated subterranean formation, as an example.

It is well known in the subterranean well drilling and completion art that particulate materials such as sand may be produced during the production of hydrocarbons from a well traversing an unconsolidated or loosely consolidated subterranean formation. Numerous problems may occur as a result of the production of such particulate. For example, the particulate causes abrasive wear to components within the well, such as the tubing, pumps and valves. In addition, the particulate may partially or fully clog the well creating the need for an expensive workover. Also, if the particulate matter is produced to the surface, it must be removed from the hydrocarbon fluids by processing equipment at the surface.

One method for preventing the production of such particulate material to the surface is gravel packing the well adjacent the unconsolidated or loosely consolidated production interval. In a typical gravel pack completion, a sand control screen is lowered into the wellbore on a work string to a position proximate the desired production interval. A fluid slurry including a liquid carrier and a particulate material known as gravel is then pumped down the work string and into the well annulus formed between the sand control screen and the perforated well casing or open hole production zone.

The liquid carrier either flows into the formation or returns to the surface by flowing through the sand control screen or both. In either case, the gravel is deposited around the sand control screen to form a gravel pack, which is highly permeable to the flow of hydrocarbon fluids but blocks the flow of the particulate carried in the hydrocarbon fluids. As such, gravel packs can successfully prevent the problems associated with the production of particulate materials from the formation.

It has been found, however, that a complete gravel pack of the desired production interval is difficult to achieve particularly in long or inclined/horizontal production intervals. These incomplete packs are commonly a result of the liquid carrier entering a permeable portion of the production interval causing the gravel to form a sand bridge in the annulus. Thereafter, the sand bridge prevents the slurry from flowing to the remainder of the annulus which, in turn, prevents the placement of sufficient gravel in the remainder of the annulus.

Prior art devices and methods have been developed which attempt to overcome this sand bridge problem. For example, attempts have been made to use tubing positioned exteriorly along the length of the sand control screens to provide an alternate path for the fluid slurry around the sand bridge. It has been found, however, that this exterior tubing is susceptible to damage during installation in the wellbore, particularly in the region between adjacent joints of the sand control screens. Therefore, a need has arisen for an apparatus for gravel packing a production interval that overcomes the problems created by sand bridges. A need has also arisen for such an apparatus that is not susceptible to damage during installation.

SUMMARY OF THE INVENTION

The present invention disclosed herein is directed to a gravel packing apparatus having a jumper tube protection assembly. The gravel packing apparatus of the present invention is operable to overcome the problems created by sand bridges. In addition, the gravel packing apparatus of the present invention is not susceptible to damage during installation.

In one aspect, the present invention is directed to a gravel packing apparatus that includes a sand control screen assembly having a filter medium positioned exteriorly of a base pipe and a slurry delivery subassembly positioned exteriorly of the sand control screen assembly. The slurry delivery subassembly includes at least one transport tube extending longitudinally along at least a portion of the sand control screen assembly. At least one jumper tube is coupled to and extends between the at least one transport tube of the first joint and the at least one transport tube of the second joint. A jumper tube protection assembly extends between the first and second joints and is positioned exteriorly of the at least one jumper tube.

In some embodiments, the jumper tube protection assembly is in the form of a cage assembly. In these embodiments, the cage assembly may include a plurality of circumferentially distributed plate members having gaps therebetween. Alternatively, in these embodiments, the cage assembly may include a plurality of circumferentially distributed ribs having a wrap wire positioned therearound. As another alternative, the cage assembly may have a plurality of circumferentially distributed ribs having a sheet member helically positioned therearound. In a further alternative, the cage assembly may have a plurality of circumferentially distributed bowsprings having gaps therebetween, wherein the bowsprings have an outer diameter greater than an outer diameter of the first and second joints. In certain embodiments, the jumper tube protection assembly may be formed from a plurality of circumferentially distributed plate members. In still other embodiments, the jumper tube protection assembly may be formed from a housing assembly having a plurality of circumferentially distributed blades, wherein the blades have an outer diameter greater than an outer diameter of the first and second joints.

In another aspect, the present invention is directed to a gravel packing apparatus that includes a sand control screen assembly having a filter medium positioned exteriorly of a base pipe and a slurry delivery subassembly positioned exteriorly of the sand control screen assembly. The slurry delivery subassembly includes at least one transport tube extending longitudinally along at least a portion of the sand control screen assembly. At least one jumper tube is coupled to and extends between the at least one transport tube of the first joint and the at least one transport tube of the second joint. A jumper tube protection assembly extends between the first and second joints and is positioned exteriorly of the at least one jumper tube, wherein the jumper tube protection assembly has an outer diameter greater than an outer diameter of the first and second joints.

In one embodiment, the jumper tube protection assembly may include a cage assembly having a plurality of circumferentially distributed bowsprings having gaps therebetween, wherein the bowsprings have an outer diameter greater than an outer diameter of the first and second joints. In another embodiment, the jumper tube protection assembly may include a housing assembly having a plurality of circumferentially distributed blades, wherein the blades have an outer diameter greater than an outer diameter of the first and second joints. In certain embodiments, the jumper tube protection assembly may have a pair of hinged collars.

In a further aspect, the present invention is directed to a method for assembling a gravel packing apparatus. The method includes providing first and second joints each including a sand control screen assembly having a filter medium positioned exteriorly of a base pipe and a slurry delivery subassembly positioned exteriorly of the sand control screen assembly, the slurry delivery subassembly including at least one transport tube extending longitudinally along at least a portion of the sand control screen assembly; threadably coupling the sand control screen assembly of the first joint to the sand control screen assembly of the second joint; coupling at least one jumper tube between the at least one transport tube of the first joint and the at least one transport tube of the second joint; and positioning a jumper tube protection assembly exteriorly around adjacent end portions of the first and second joints and the at least one jumper tube.

The method may also include forming a cage assembly by circumferentially distributing a plurality of plate members having gaps therebetween exteriorly around the at least one jumper tube, circumferentially distributing a plurality of plate members exteriorly around the at least one jumper tube, bolting the plate members to the sand control screen assemblies of the first and second joints, forming a cage assembly by circumferentially distributing a plurality of bowsprings having gaps therebetween exteriorly around the at least one jumper tube, wherein the bowsprings have an outer diameter greater than an outer diameter of the first and second joints and/or positioning a housing assembly having a plurality of circumferentially distributed blades exteriorly around the at least one jumper tube, wherein the blades have an outer diameter greater than an outer diameter of the first and second joints.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts, which can be embodied in a wide variety of specific contexts. The specific embodiments discussed herein are merely illustrative of specific ways to make and use the invention, and do not delimit the scope of the present invention.

Figure 1:
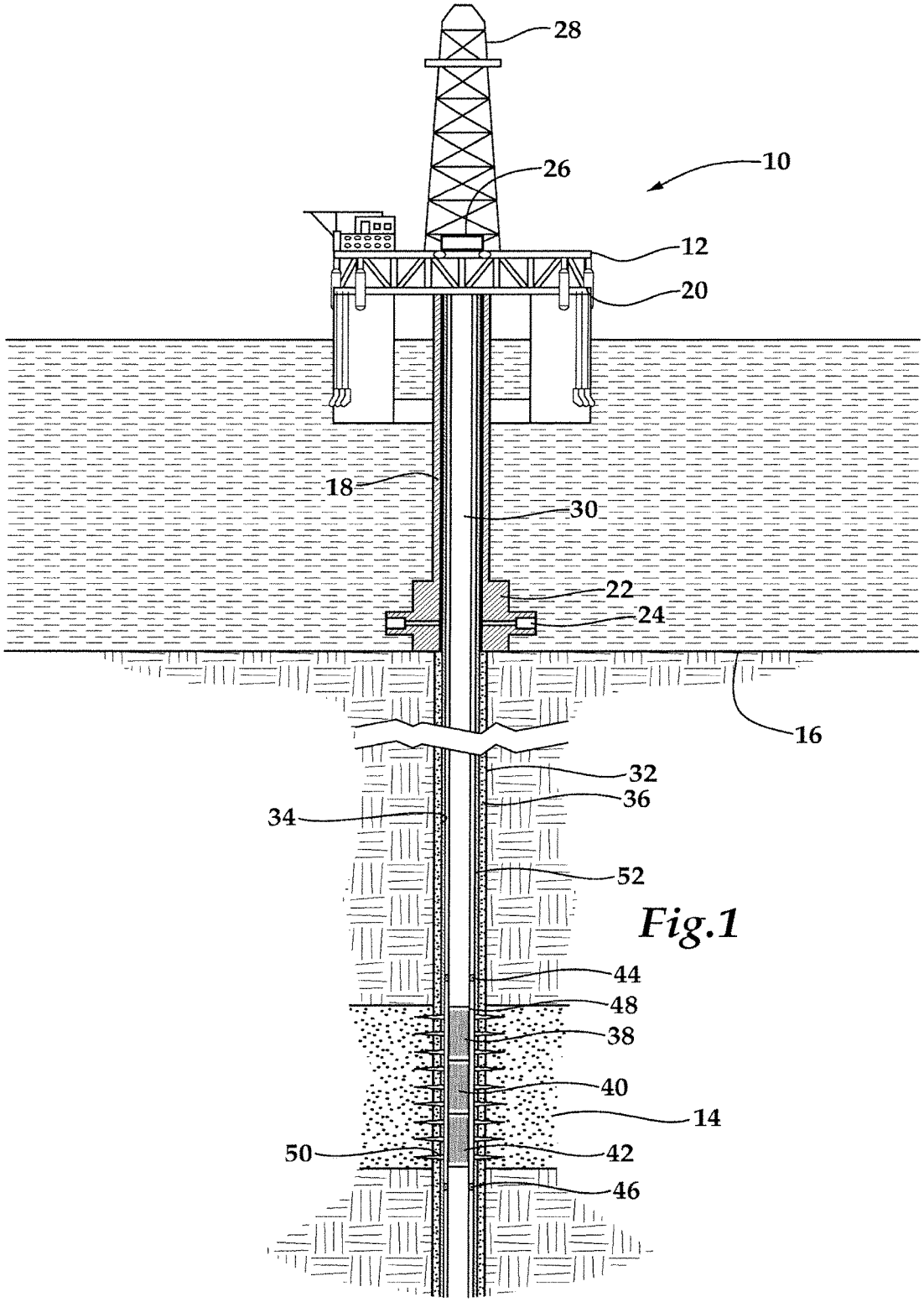
FIG. 1 is a schematic illustration of an offshore platform operating a gravel packing apparatus having a jumper tube protection assembly according to an embodiment of the present invention.

Referring initially to FIG. 1, a gravel packing apparatus positioned in an interval of a wellbore and operating from an offshore oil and gas platform is schematically illustrated and generally designated 10. A semi-submersible platform 12 is centered over a submerged oil and gas formation 14 located below sea floor 16. A subsea conduit 18 extends from deck 20 of platform 12 to wellhead installation 22 including blowout preventers 24. Platform 12 has a hoisting apparatus 26 and a derrick 28 for raising and lowering pipe strings such as work string 30.

A wellbore 32 extends through the various earth strata including formation 14. A casing 34 is secured within wellbore 32 by cement 36. Work string 30 includes various tools including joints 38, 40, 42 that form the gravel packing apparatus of the present invention that is positioned in an interval of wellbore 32 adjacent to formation 14 between packers 44, 46. When it is desired to gravel pack annular region 48 surrounding joints 38, 40, 42, a fluid slurry including a liquid carrier and a particulate material such as sand, gravel or proppants is pumped down work string 30.

Some or all of the fluid slurry is typically injected directly into annular region 48 in a known manner, such as through a crossover tool (not pictured), which allows the slurry to travel from the interior of work string 30 to the exterior of work string 30. Once the fluid slurry is in annular region 48, a portion of the gravel in the fluid slurry is deposited in annular region 48. Some of the liquid carrier may enter formation 14 through perforation 50 while the remainder of the fluid carrier along with some of the gravel enters certain sections of joints 38, 40, 42 filling those sections with gravel. The sand control screens within joints 38, 40, 42 disallows further migration of the gravel but allows the liquid carrier to travel therethrough into work string 30 and up to the surface via annulus 52. If sand bridges form in annular region 48, some or all of the fluid slurry is injected or diverted into the slurry delivery subassemblies within joints 38, 40, 42 to bypass the sand bridge such that a complete pack can be achieved.

Even though FIG. 1 depicts the gravel packing apparatus of the present invention in a vertical wellbore, it should be understood by those skilled in the art that the gravel packing apparatus of the present invention is equally well suited for use in wellbores having other directional configurations including horizontal wellbores, deviated wellbores, slanted wells, lateral wells and the like. Accordingly, it should be understood by those skilled in the art that the use of directional terms such as above, below, upper, lower, upward, downward, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well. Also, even though FIG. 1 depicts an offshore operation, it should be noted by one skilled in the art that the gravel packing apparatus of the present invention is equally well-suited for use in onshore operations. Further, even though FIG. 1 depicts the gravel packing apparatus of the present invention as having a particular number of joints, it should be understood by those skilled in the art that a gravel packing apparatus of the present invention may have any number of joints both less than or greater than the number shown.

Figure 2:
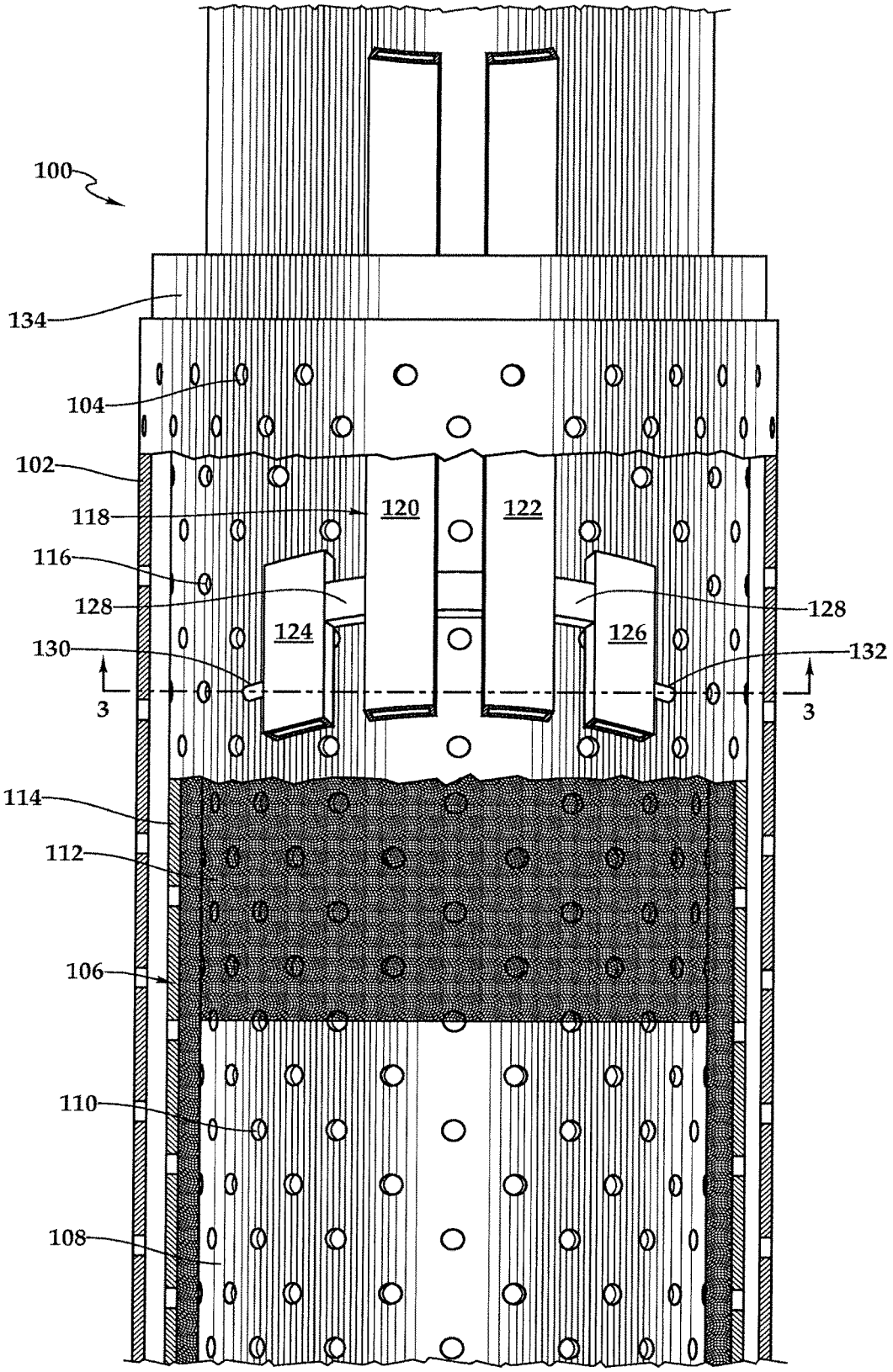
FIG. 2 is a side view partially in cut away of a gravel packing apparatus having a jumper tube protection assembly according to an embodiment of the present invention.

Referring next to FIG. 2, therein is depicted a cut away view of a gravel packing apparatus of the present invention that is generally designated 100. Apparatus 100 has an outer tubular or shroud 102 that includes a plurality of openings 104 that are substantially evenly distributed around and along the length of outer tubular 102, which allow the flow of production fluids therethrough. Disposed within outer tubular 102 is a sand control screen assembly 106. Sand control screen assembly 106 includes a base pipe 108 that has a plurality of openings 110 which allow the flow of production fluids into the production tubing. The exact number, size and shape of openings 110 are not critical to the present invention, so long as sufficient area is provided for fluid production and the integrity of base pipe 108 is maintained.

Positioned around base pipe 108 is a filter medium depicted as a fluid-porous, particulate restricting wire mesh screen 112. Screen 112 is designed to allow fluid flow therethrough but prevent the flow of particulate materials of a predetermined size from passing therethrough. Screen 112 preferably has a plurality of layers of wire mesh including one or more drainage layers and one or more filter layers wherein the drainage layers that have a mesh size that is larger than the mesh size of the filter layers. For example, a drainage layer may preferably be positioned as the outermost layer and the innermost layer of wire mesh screen 112 with the filter layer or layers positioned therebetween. Positioned around screen 112 is a screen wrapper 114 that has a plurality of openings 116 which allow the flow of production fluids therethrough. The exact number, size and shape of openings 116 is not critical to the present invention, so long as sufficient area is provided for fluid production and the integrity of screen wrapper 114 is maintained. Typically, various sections of screen 112 and screen wrapper 114 are manufactured together as a unit by, for example, diffusion bonding or sintering the layers of wire mesh that form screen 112 together with screen wrapper 114, then rolling the unit into a tubular configuration. The two ends of the tubular unit are then seam welded together. Several tubular units of the screen and screen wrapper combination may be placed over each joint of base pipe 108 and secured thereto by welding or other suitable technique. It should be understood by those skilled in the art that even though FIG. 2 has described a particular filter medium, other types of filter media could alternatively be used in conjunction with the apparatus of the present invention, including, but not limited to, a wire wrapped sand control screen.

Disposed between outer tubular 102 and sand control screen assembly 106 is a slurry delivery subassembly 118. In the illustrated embodiment, slurry delivery subassembly 118 includes a pair of transport tubes 120, 122, a pair of packing tubes 124, 126 and a manifold 128 that provides fluid communication between transport tubes 120, 122 and packing tubes 124, 126. As illustrated, transport tubes 120, 122 extend longitudinally past outer tubular 102 such that the transport tubes 120, 122 of one joint can be fluidically coupled to the transport tubes 120, 122 of another joint as explained in greater detail below. Packing tubes 124, 126 each include a plurality of nozzles, such as nozzle 130 of packing tube 124 and nozzle 132 of packing tube 126. In the event of sand bridge formation or as part of a planned gravel packing process, some or all of the fluid slurry is injected into the slurry delivery subassembly 118 of the uppermost joint. The fluid slurry is able to travel from one joint to the next via the transport tubes 120, 122. As the fluid slurry travels from joint to joint, portions of the fluid slurry enter packing tubes 124, 126 via manifold 128. From packing tubes 124, 126, the fluid slurry is able to enter the annular region surrounding gravel packing apparatus 100 by exiting slurry delivery subassembly 118 via nozzles 130, 132. In this manner, a complete gravel pack may be achieved even if sand bridges form in the annular region surrounding gravel packing apparatus 100.

In the illustrated embodiment, transport tubes 120, 122 extend through a ring assembly 134 that is preferably welded to base pipe 108. Likewise, outer tubular 102 may be welded to ring assembly 134. Ring assembly 134 may be eccentric in design such that it has suitable thickness to receive and support transport tubes 120, 122 on one side but may be thinner on the opposite side. Ring assembly 134 may be a single solid ring or may be formed from ring sections that substantially form a solid ring or may form a circumferentially segmented ring having gaps between the ring sections. Ring assembly 134 may include multiple components that receive and support transport tubes 120, 122 and may have notches, slots or openings that receive and support transport tubes 120, 122. It should be understood by those skilled in the art that even though transport tubes 120, 122 are depicted as extending through ring assembly 134, transport tubes may cooperate with a ring assembly in alternate ways, including, but not limited to, extending only partially into openings of a ring assembly or otherwise being fluidically coupled to one side of a ring assembly wherein the openings of the ring assembly become part of a fluid path for the fluid slurry. In such an embodiment, the jumper tubes that fluidically couple the transport tubes of one joint with the transport tubes of the adjacent joint are similarly partially inserted into the openings of the ring assembly or otherwise fluidically coupled to the other side of the ring assembly.

Figure 3:
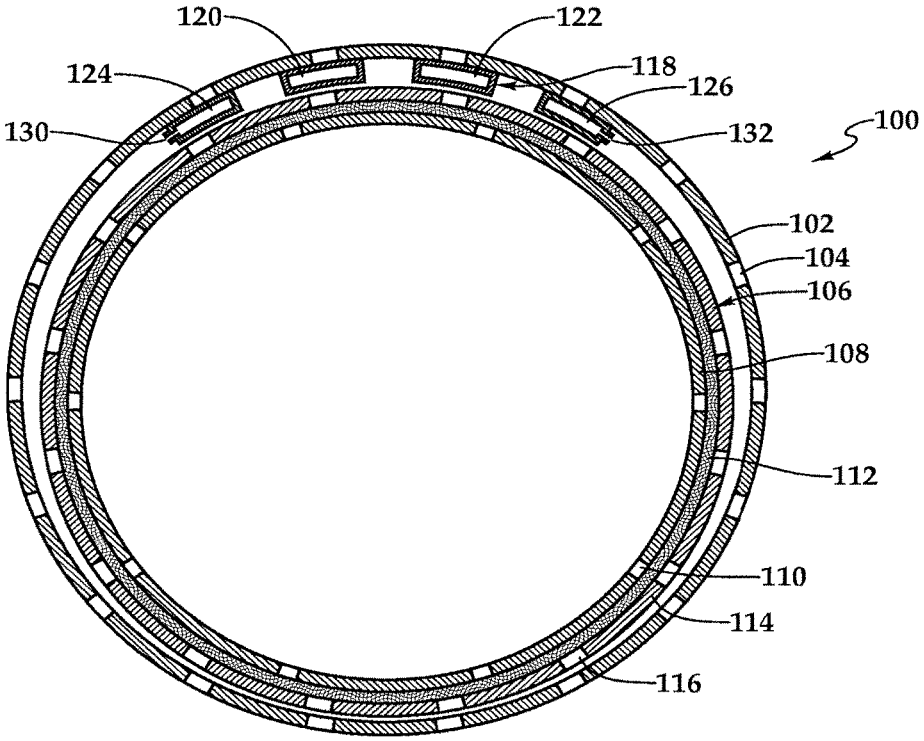
FIG. 3 is a cross sectional view of a gravel packing apparatus having a jumper tube protection assembly according to an embodiment of the present invention.
Figure 4:
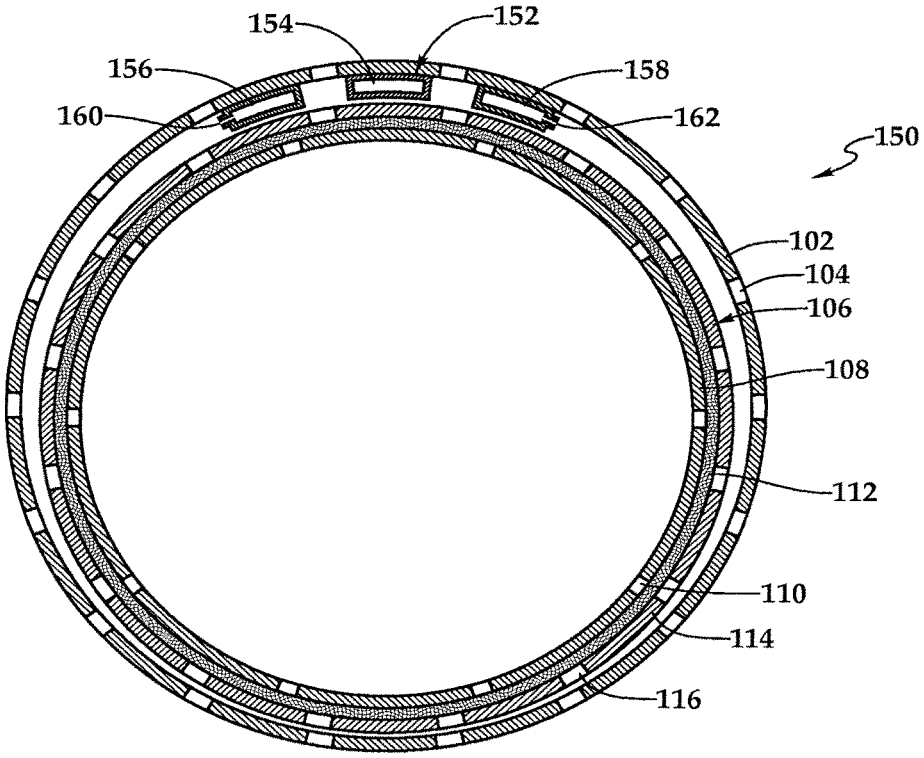
FIG. 4 is a cross sectional view of a gravel packing apparatus having a jumper tube protection assembly according to an embodiment of the present invention.
Figure 5:
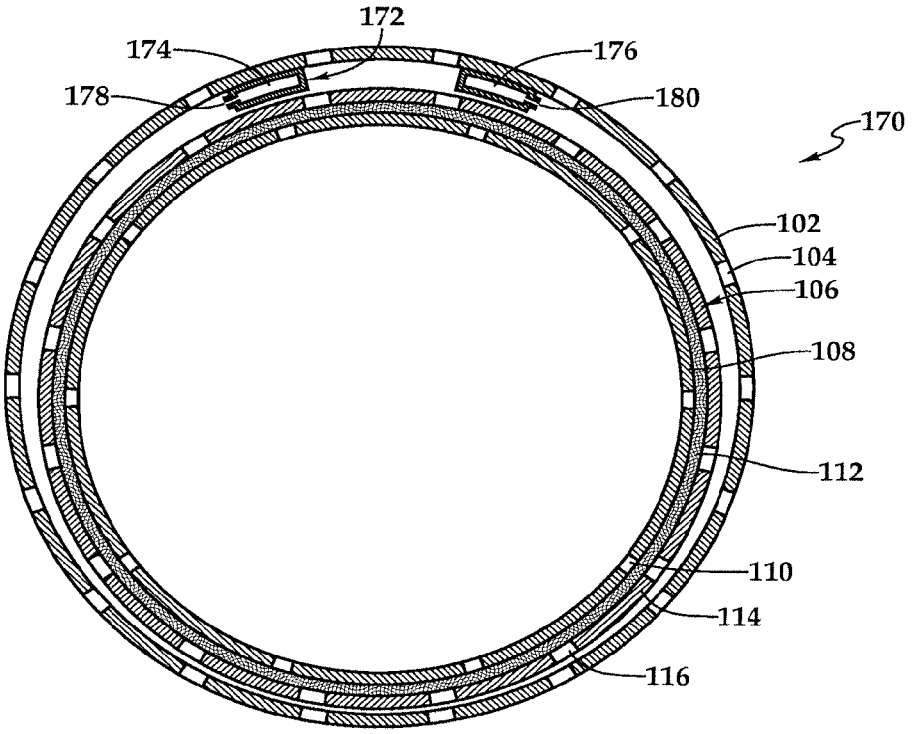
FIG. 5 is a cross sectional view of a gravel packing apparatus having a jumper tube protection assembly according to an embodiment of the present invention.
Figure 6:
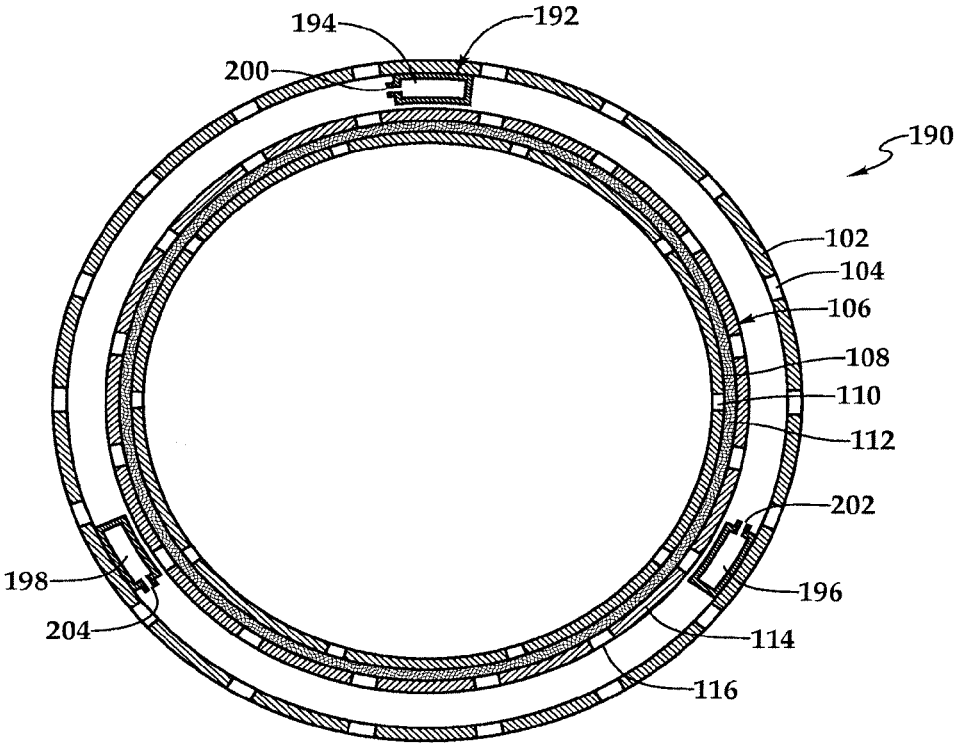
FIG. 6 is a cross sectional view of a gravel packing apparatus having a jumper tube protection assembly according to an embodiment of the present invention.

As best seen in FIG. 3, sand control screen assembly 106 may be eccentrically positioned within outer tubular 102 to enable slurry delivery subassembly 118 to be positioned therebetween while maintaining a desired outer diameter of gravel packing apparatus 100. It should be understood by those skilled in the art, however, that even though FIGS. 2 and 3 have described a particular slurry delivery subassembly, other slurry delivery subassembly having other configurations could alternatively be used in conjunction with the apparatus of the present invention. For example, as best seen in FIG. 4, a gravel packing apparatus 150 is depicted having a slurry delivery subassembly 152 including a single transport tube 154 and a pair of packing tubes 156, 158 each having a plurality of nozzles 160, 162 in an eccentric design. In another example, as best seen in FIG. 5, a gravel packing apparatus 170 is depicted having a slurry delivery subassembly 172 including a pair of slurry delivery tubes 174, 176 that serve as both transport tubes, as they extend from joint to joint, as well as packing tubes, as each has a plurality of nozzles 178, 180. Gravel packing apparatus 170 also has an eccentric design. In a further example, as best seen in FIG. 6, a gravel packing apparatus 190 is depicted having a slurry delivery subassembly 192 including three slurry delivery tubes 194, 196, 198 that serve as both transport tubes, as they extend from joint to joint, as well as packing tubes, as each has a plurality of nozzles 200, 202, 204. Unlike the previously described gravel packing apparatuses, gravel packing apparatus 190 has a concentric design wherein sand control screen assembly 106 is concentrically positioned within the outer tubular 102 with slurry delivery tubes 194, 196, 198 circumferentially distributed therebetween.

Figure 7A:
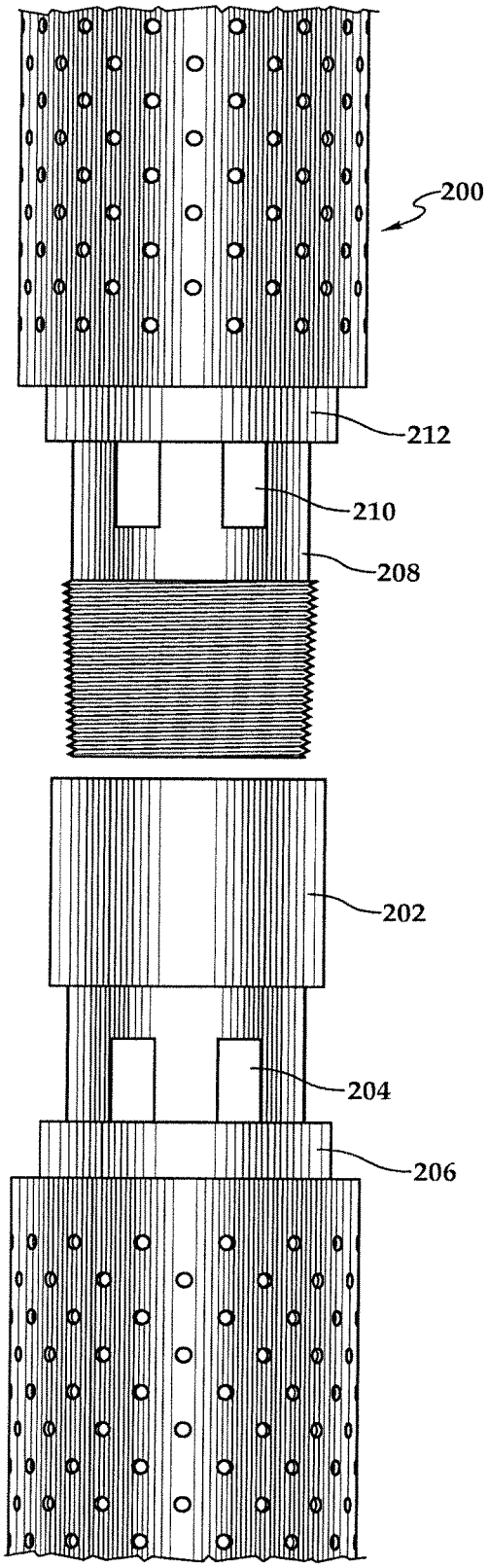
FIGS. 7A-7D are schematic illustration of the process of coupling two joints of a gravel packing apparatus having a jumper tube protection assembly according to an embodiment of the present invention.
Figure 7B:
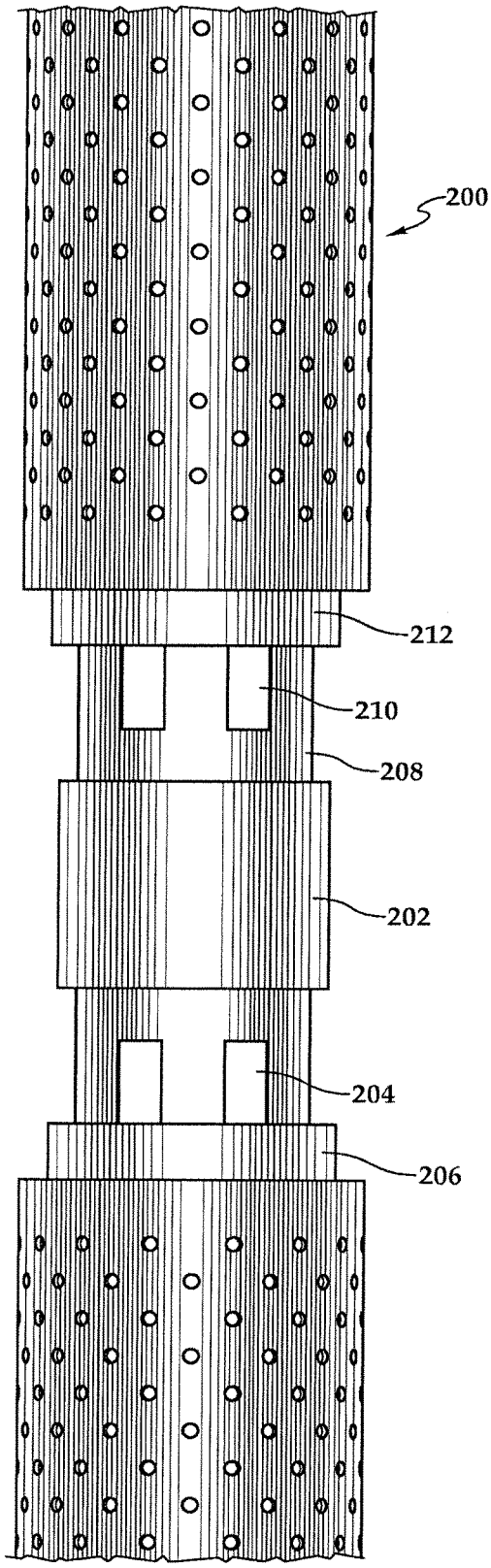
Figure 7C:
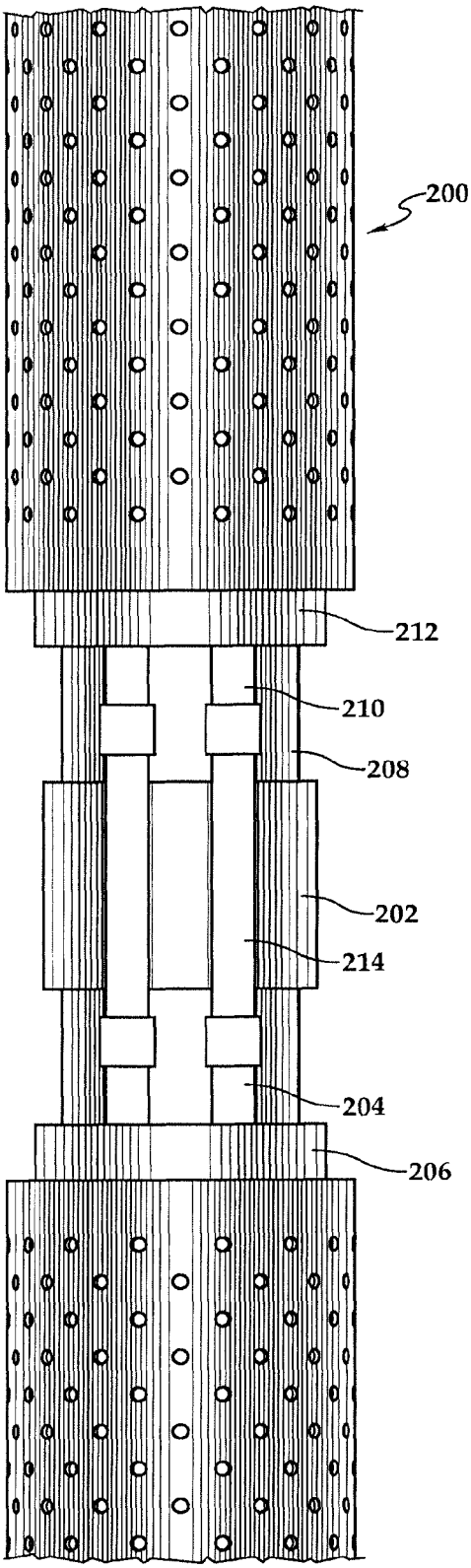

The operation of the assembling a gravel packing apparatus 200 of the present invention will now be described with reference to FIGS. 7A-7D. A lower joint of gravel packing apparatus 200 is depicted as joint 202 having a pair of transport tubes 204 supported by a ring assembly 206. Joint 202 is supported by the well platform in, for example, a screen table assembly attached to the rotary table generally located on the well floor of the platform (not pictured). An upper joint of gravel packing apparatus 200 is depicted as joint 208 having a pair of transport tubes 210 supported by a ring assembly 212. Upper joint 208 has been maneuvered into position above joint 202 using the hoisting apparatus of the well platform (not pictured). Joints 202 and 208 are now threadably connected to one another to form coupled joint, as best seen in FIG. 7B, which may be supported by the hoisting apparatus of the well platform (not pictured). Once in this position, jumper tubes 214 may be coupled between transport tubes 210 of joint 208 and transport tubes 204 of joint 202 which establishes fluid communication therebetween and preferably a fluid tight seal therebetween, as best seen in FIG. 7C.

Figure 7D:
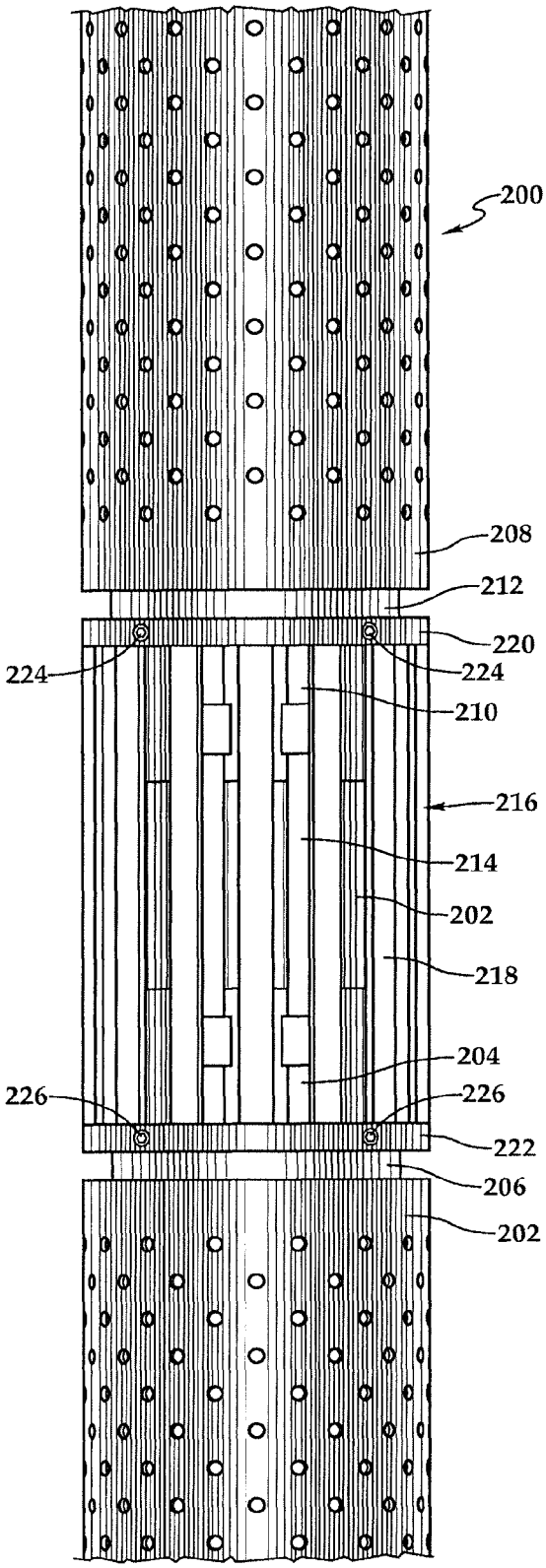

After jumper tubes 214 have been connected, a jumper tube protection assembly 216 is installed, as best seen in FIG. 7D. In the illustrated embodiment, jumper tube protection assembly 216 extends between joints 202, 208 and is positioned to the exterior and around the coupled joint including jumper tubes 214. Jumper tube protection assembly 216 is depicted as a cage assembly having a plurality of circumferentially distributed plate members 218 having gaps therebetween that extend between a pair of oppositely disposed collars 220, 222. As illustrated, collar 220 is connected to ring assembly 212 by set screws 224. Likewise, collar 222 is connected to ring assembly 206 by set screws 226. Jumper tube protection assembly 216 may be prefabricated in sections such that two or more sections form the cage assembly with each section being independently connected to ring assemblies 206, 212. Alternatively, the cage assembly may have hinged collars 220, 222 that enable jumper tube protection assembly 216 to be installed in a clamshell type operation. As another alternative, the entire jumper tube protection assembly 216 may be constructed on the rig floor by installing each of the individual plate member 218 into the opposing collars 220, 222 as gravel packing apparatus 200 is being connected and deployed. As yet another alternative, the jumper tube protection assembly 216 may be prefabricated as part of the upper portion of joint 202 or as part of the lower portion of joint 208 then slid into place around the coupled joint including jumper tubes 214. As such, jumper tube protection assemblies 216 of the present invention provide protection against damage to jumper tubes 214 during installation and deployment of gravel packing apparatus 200 into the wellbore.

Figure 8:
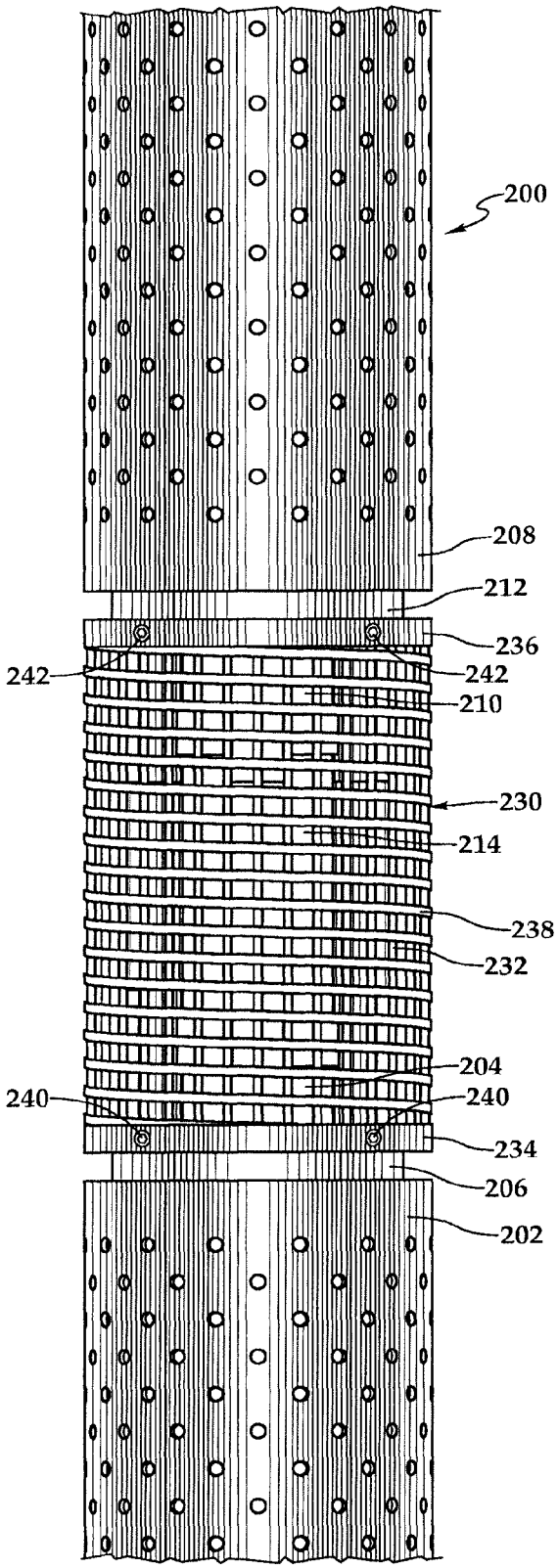
FIG. 8 is a side view of a gravel packing apparatus having a jumper tube protection assembly according to an embodiment of the present invention.

Referring now to FIG. 8, another embodiment of a jumper tube protection assembly 230 is depicted in place on gravel packing apparatus 200. Jumper tube protection assembly 230 is depicted as a cage assembly having a plurality of circumferentially distributed ribs 232 that extend between a pair of oppositely disposed collars 234, 236 having a screen wire 238 wrapped therearound. As illustrated, collar 234 is connected to ring assembly 206 by set screws 240. Likewise, collar 236 is connected to ring assembly 212 by set screws 242. Jumper tube protection assembly 230 may be prefabricated in multiple sections that are independently connected to ring assemblies 206, 212, it may have hinged collars 234, 236 for clam shell type installation, it may be prefabricated as part of the upper portion of joint 202 or as part of the lower portion of joint 208 then slid into place around the coupled joint including jumper tubes 214 or installed in another suitable manner. As such, jumper tube protection assemblies 230 of the present invention provide protection against damage to jumper tubes 214 during installation and deployment of gravel packing apparatus 200 into the wellbore.

Figure 9:
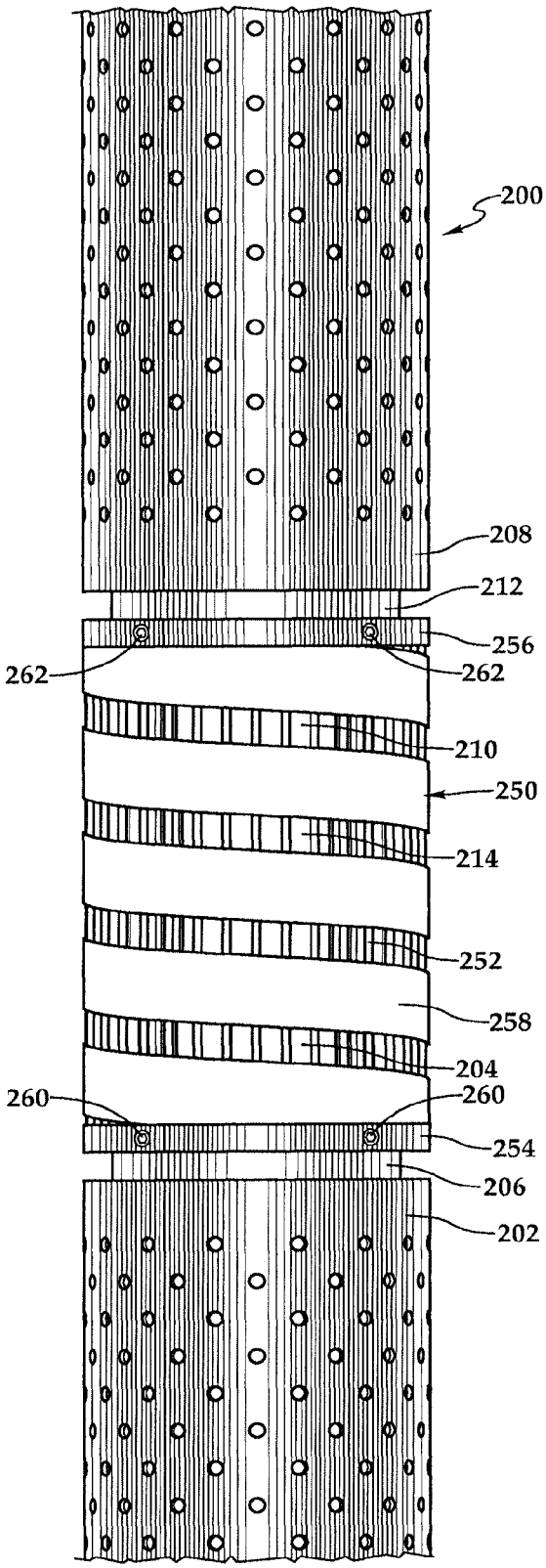
FIG. 9 is a side view of a gravel packing apparatus having a jumper tube protection assembly according to an embodiment of the present invention.

Referring now to FIG. 9, another embodiment of a jumper tube protection assembly 250 is depicted in place on gravel packing apparatus 200. Jumper tube protection assembly 250 is depicted as a cage assembly having a plurality of circumferentially distributed ribs 252 that extend between a pair of oppositely disposed collars 254, 256 having a sheet metal wrapper 258 positioned therearound. As illustrated, collar 254 is connected to ring assembly 206 by set screws 260. Likewise, collar 256 is connected to ring assembly 212 by set screws 262. Jumper tube protection assembly 250 may be prefabricated in multiple sections that are independently connected to ring assemblies 206, 212, it may have hinged collars 254, 254 for clam shell type installation, it may be prefabricated as part of the upper portion of joint 202 or as part of the lower portion of joint 208 then slid into place around the coupled joint including jumper tubes 214, or installed in another suitable manner. Sheet metal wrapper 258 may be prefabricated on ribs 252 or installed on the rig floor as gravel packing apparatus 200 is being connected and deployed. As such, jumper tube protection assemblies 250 of the present invention provide protection against damage to jumper tubes 214 during installation and deployment of gravel packing apparatus 200 into the wellbore.

Figure 10:
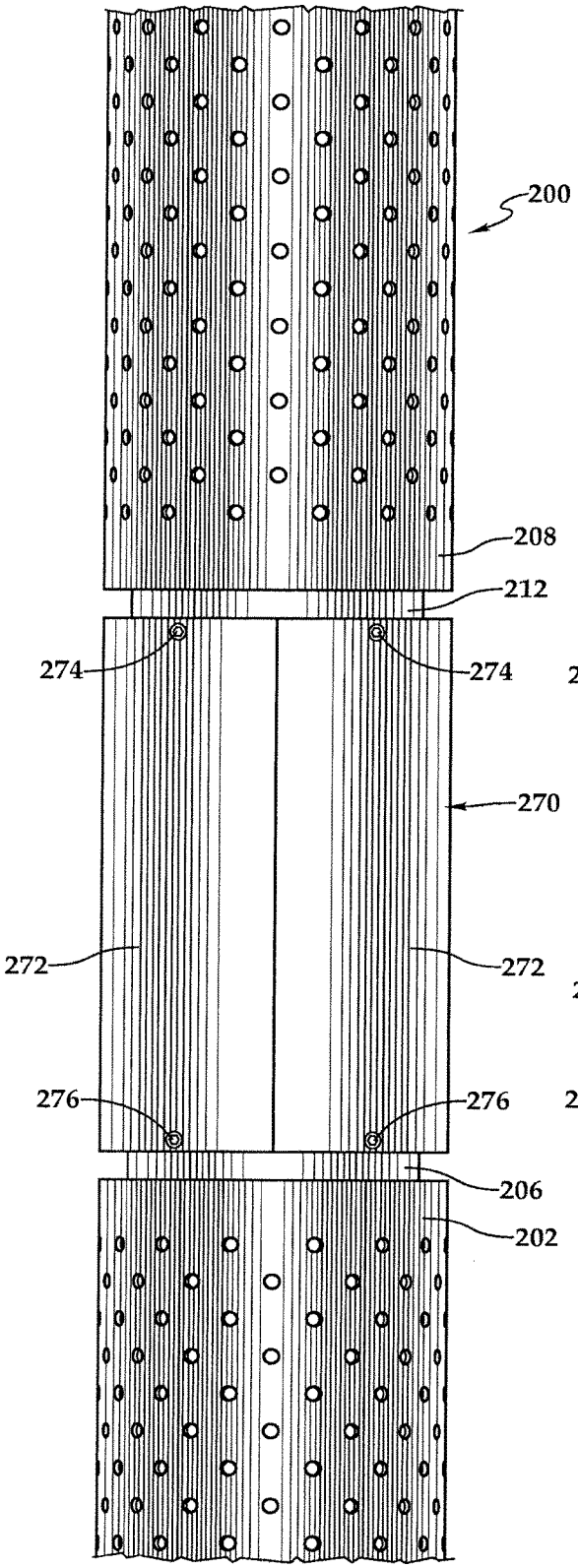
FIG. 10 is a side view of a gravel packing apparatus having a jumper tube protection assembly according to an embodiment of the present invention.

Referring now to FIG. 10, another embodiment of a jumper tube protection assembly 270 is depicted in place on gravel packing apparatus 200. Jumper tube protection assembly 270 is depicted as a plurality of circumferentially distributed plate members 272 that extend between ring assemblies 206, 212 and are attached thereto by set screws 274, 276. In the illustrated embodiment, each of the plate members has substantially the same construction and extends circumferentially approximately ninety degrees around the coupled joint. As such, jumper tube protection assemblies 270 of the present invention provide protection against damage to jumper tubes 214 during installation and deployment of gravel packing apparatus 200 into the wellbore.

Figure 11:
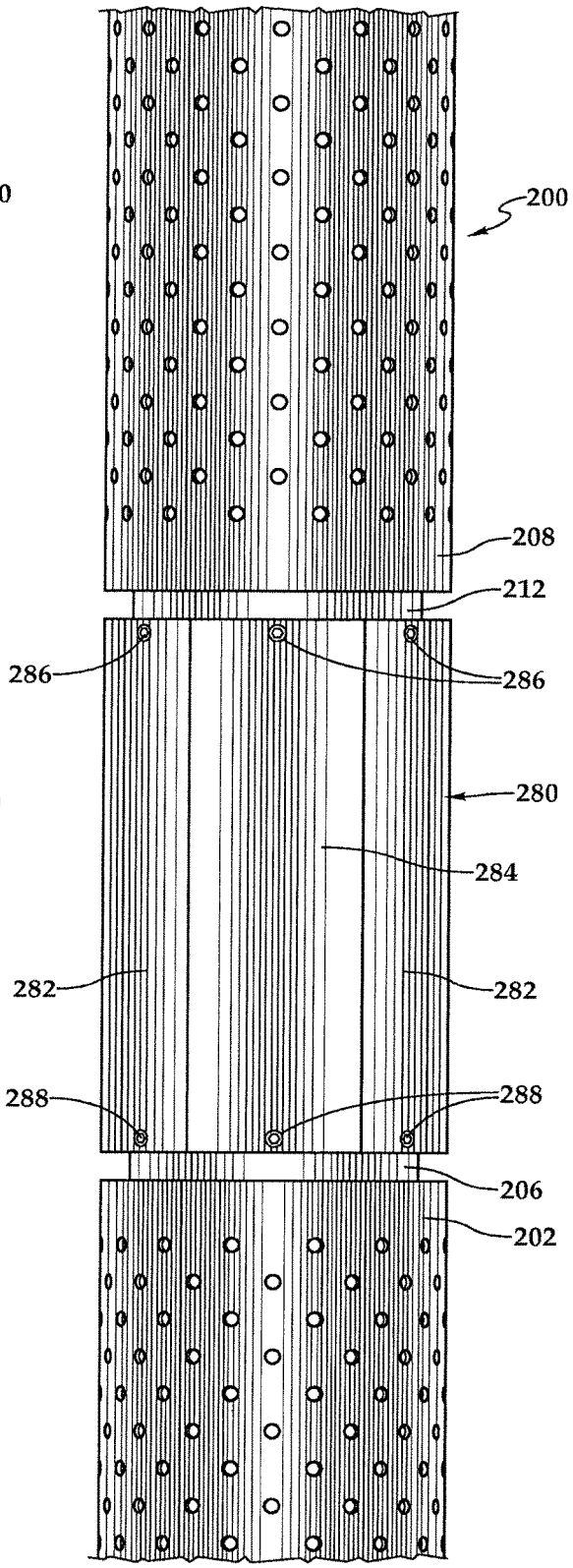
FIG. 11 is a side view of a gravel packing apparatus having a jumper tube protection assembly according to an embodiment of the present invention.

Referring now to FIG. 11, another embodiment of a jumper tube protection assembly 280 is depicted in place on gravel packing apparatus 200. Jumper tube protection assembly 280 is depicted as a plurality of circumferentially distributed plate members including a pair of side plate members 282 and a central plate member 284 that extend between ring assemblies 206, 212 and are attached thereto by set screws 286, 288. In the illustrated embodiment, central plate member 284 extends circumferentially approximately sixty degrees around the coupled joint and is designed to cooperate with jumper tubes 214. Side plate members 282 each extend circumferentially approximately one hundred and fifty degrees around the coupled joint. As such, jumper tube protection assemblies 280 of the present invention provide protection against damage to jumper tubes 214 during installation and deployment of gravel packing apparatus 200 into the wellbore.

Figure 12:
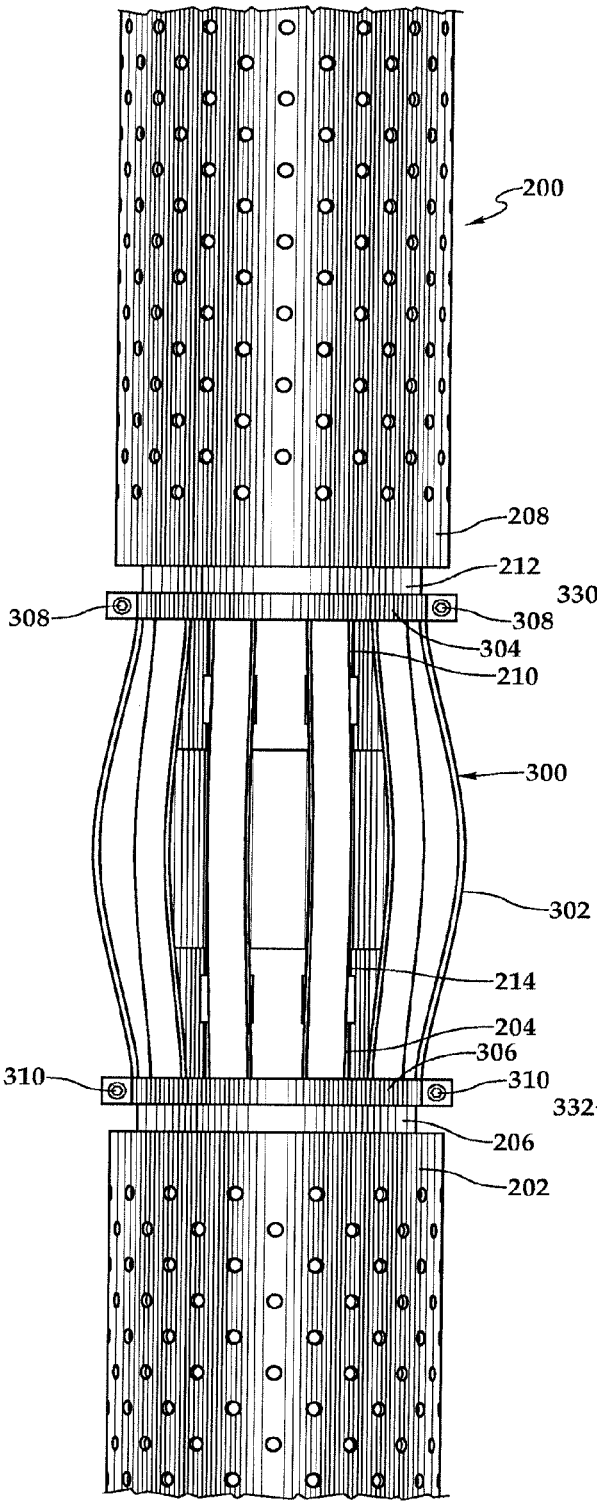
FIG. 12 is a side view of a gravel packing apparatus having a jumper tube protection assembly according to an embodiment of the present invention.

Referring now to FIG. 12, another embodiment of a jumper tube protection assembly 300 is depicted in place on gravel packing apparatus 200. In the illustrated embodiment, jumper tube protection assembly 300 is depicted as a cage assembly having a plurality of circumferentially distributed bowsprings 302 having gaps therebetween that extend between a pair of oppositely disposed collars 304, 306. As illustrated, jumper tube protection assembly 300 is prefabricated in two sections that are bolted, clamped or otherwise secured together at tabs 308, 310. Importantly, bowsprings 302 have an outer diameter that is greater than the outer diameter of joints 202, 208 such that jumper tube protection assembly 300 not only provides protection against damage to jumper tubes 214 during installation and deployment of gravel packing apparatus 200 into the wellbore, but also, provides a centralization function to gravel packing apparatus 200.

Figure 13:
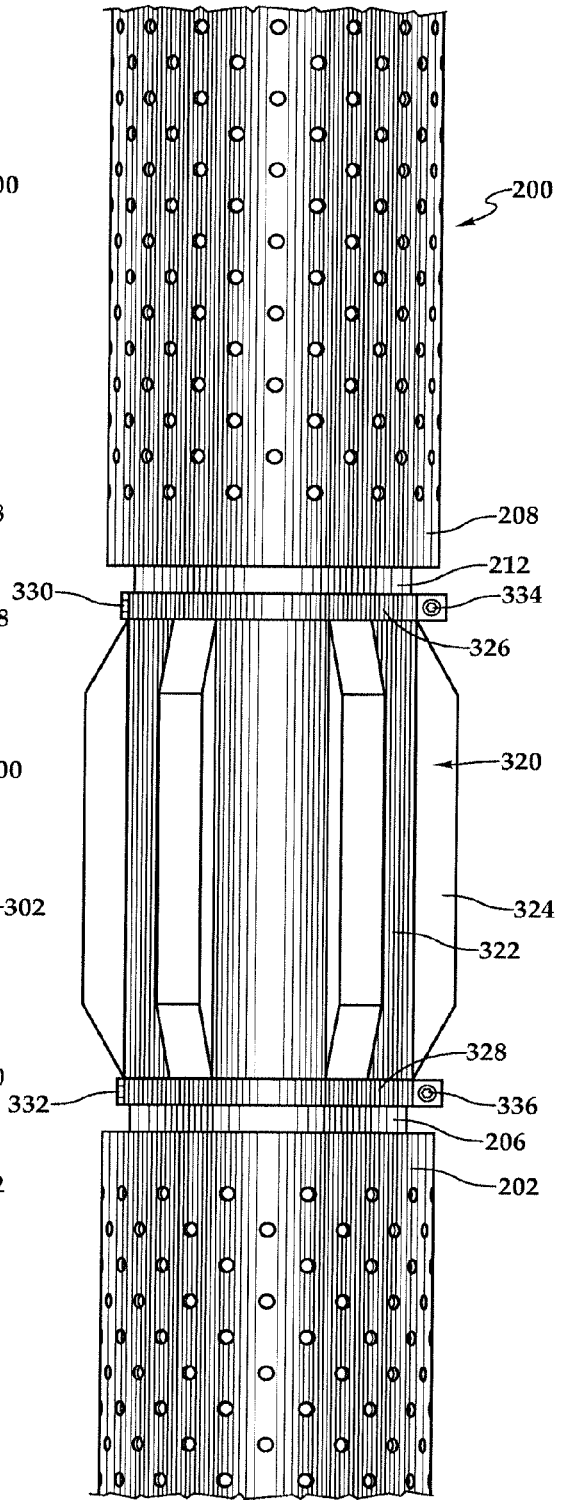
FIG. 13 is a side view of a gravel packing apparatus having a jumper tube protection assembly according to an embodiment of the present invention.

Referring now to FIG. 13, another embodiment of a jumper tube protection assembly 320 is depicted in place on gravel packing apparatus 200. In the illustrated embodiment, jumper tube protection assembly 320 includes a housing 322 with a plurality of circumferentially distributed blades 324 radially extending therefrom. Housing 322 extends between a pair of oppositely disposed collars 326, 328. As illustrated, jumper tube protection assembly 320 is prefabricated in two sections that rotatably coupled together at hinges 330, 332 enabling installation in a clam shell manner. Thereafter, the two sections are bolted, clamped or otherwise secured together at tabs 334, 336. Blades 324 may be solid members or may be spring members. Importantly, blades 324 have an outer diameter that is greater than the outer diameter of joints 202, 208 such that jumper tube protection assembly 320 not only provides protection against damage to jumper tubes 214 during installation and deployment of gravel packing apparatus 200 into the wellbore, but also, provides a centralization function to gravel packing apparatus 200.

While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

What is claimed is:

1. A gravel packing apparatus comprising:

first and second joints, each comprising:

a sand control screen assembly comprising a base pipe and a filter medium, the filter medium positioned exteriorly of the base pipe; and a slurry delivery subassembly positioned exteriorly of the sand control screen assembly, the slurry delivery subassembly comprising:

a ring assembly positioned around the base pipe; and a transport tube extending through the ring assembly and longitudinally along at least a portion of the sand control screen assembly;

a jumper tube coupled to, and extending between, the transport tube of the first joint and the transport tube of the second joint; and a cage assembly extending circumferentially about respective portions of the first and second joints and positioned exteriorly of the jumper tube, the cage assembly comprising a plurality of cage sections that are each independently connected to the respective ring assemblies of the first and second joints, wherein a plurality of gaps are interposed between the plurality of cage sections.

2. The apparatus as recited in claim 1, wherein the plurality of cage sections comprise a plurality of circumferentially distributed ribs.

3. The apparatus as recited in claim 2, wherein the cage assembly further comprises at least one of:

a wrap wire positioned around the plurality of circumferentially distributed ribs; and a sheet member positioned helically around the plurality of circumferentially distributed ribs.

4. The apparatus as recited in claim 1, wherein each of the first and second joints further comprises an outer shroud positioned around the slurry delivery subassembly and the sand control screen assembly.

5. The apparatus as recited in claim 1, wherein the slurry delivery subassembly of each of the first and second joints further comprises at least one packing tube having nozzles.

6. The apparatus as recited in claim 1, wherein the cage assembly has an outer diameter greater than the outer diameter of the first and second joints.

7. The gravel packing apparatus as recited in claim 1, wherein the cage assembly further comprises a housing extending between, and connected to, the respective ring assemblies of the first and second joints so that the plurality of cage sections are connected to the housing and extend between the respective ring assemblies of the first and second joints.

8. The apparatus as recited in claim 7, wherein the plurality of cage sections comprise a plurality of circumferentially distributed blades.

9. The apparatus as recited in claim 8, wherein the plurality of circumferentially distributed blades are spaced in a parallel relation.

10. The apparatus as recited in claim 7, wherein the cage assembly has an outer diameter greater than the outer diameter of the first and second joints.

11. A gravel packing apparatus comprising:

first and second joints, each comprising:

a sand control screen assembly comprising a base pipe and a filter medium, the filter medium positioned exteriorly of the base pipe; and a slurry delivery subassembly positioned exteriorly of the sand control screen assembly, the slurry delivery subassembly comprising:

a ring assembly positioned around the base pipe; and a transport tube extending through the ring assembly and longitudinally along at least a portion of the sand control screen assembly;

a jumper tube coupled to, and extending between, the transport tube of the first joint and the transport tube of the second joint; and a cage assembly extending circumferentially about respective portions of the first and second joints and positioned exteriorly of the jumper tube, the cage assembly comprising a plurality of cage sections that are each independently connected to the respective ring assemblies of the first and second joints;

wherein the plurality of cage sections comprise a plurality of circumferentially distributed plate members; and wherein a plurality of gaps are interposed between the plurality of circumferentially distributed plate members.

12. The apparatus as recited in claim 11, wherein the plurality of circumferentially distributed plate members are each bolted to the respective ring assemblies of the first and second joints.

13. A method for assembling a gravel packing apparatus, the method comprising:

providing first and second joints, each comprising:

a sand control screen assembly comprising a base pipe and a filter medium, the filter medium positioned exteriorly of the base pipe; and a slurry delivery subassembly positioned exteriorly of the sand control screen assembly, the slurry delivery subassembly comprising;

a ring assembly positioned around the base pipe; and a transport tube extending through the ring assembly and longitudinally along at least a portion of the sand control screen assembly;

threadably coupling the sand control screen assembly of the first joint to the sand control screen assembly of the second joint;

coupling a jumper tube between the transport tube of the first joint and the transport tube of the second joint; and positioning a cage assembly circumferentially about respective portions of the first and second joints and exteriorly of the jumper tube, the cage assembly comprising a plurality of cage sections that are each independently connected to the respective ring assemblies of the first and second joints, wherein a plurality of gaps are interposed between the plurality of cage sections.

14. The method as recited in claim 13, wherein positioning the cage assembly circumferentially about respective portions of the first and second joints and exteriorly of the jumper tube comprises circumferentially distributing a plurality of plate members exteriorly around the jumper tube.

15. The method as recited in claim 14, wherein circumferentially distributing the plurality of plate members exteriorly around the jumper tube comprises bolting the plate members to the ring assemblies of the first and second joints.

16. The method as recited in claim 13, wherein positioning the cage assembly circumferentially about respective portions of the first and second joints and exteriorly of the jumper tube comprises circumferentially distributing a plurality of ribs having gaps therebetween exteriorly around the jumper tube.

17. The method as recited in claim 16, wherein positioning the cage assembly circumferentially about respective portions of the first and second joints and exteriorly of the jumper tube further comprises at least one of:

positioning a wrap wire around the plurality of circumferentially distributed ribs; and positioning a sheet member helically around the plurality of circumferentially distributed ribs.

18. The method as recited in claim 13, wherein positioning a cage assembly circumferentially about respective portions of the first and second joints and exteriorly of the jumper tube comprises connecting a housing between the respective ring assemblies of the first and second joints so that the plurality of cage sections are connected to the housing and extend between the respective ring assemblies of the first and second joints.

19. The method as recited in claim 18, wherein the plurality of cage sections comprise a plurality of circumferentially distributed blades.

20. The method as recited in claim 18, wherein the cage assembly has an outer diameter greater than the outer diameter of the first and second joints.

* * * * *